US005570662A

United States Patent [19]

Niemchick et al.

[11] Patent Number: 5,570,662

[45] Date of Patent: Nov. 5, 1996

[54] INTERNAL COMBUSTION ENGINE WITH LUBRICATING OIL SUPPLY SYSTEM

[75] Inventors: Robert L. Niemchick, Lake Villa, Ill.; Gerald Haft, Brookfield, Wis.

[73] Assignee: Outboard Marine Corporation, Waukegan, Ill.

[21] Appl. No.: 541,858

[22] Filed: Oct. 10, 1995

Related U.S. Application Data

[62] Division of Ser. No. 98,418, Jul. 27, 1993, Pat. No. 5,471, 958.

[51] Int. Cl.[6] ..... F02B 33/12

[52] U.S. Cl. ..... 123/74 AE; 123/196 CP

[58] Field of Search ..... 123/74 AE, 196 R, 123/196 W, 196 CP; 184/6.5

[56] References Cited

U.S. PATENT DOCUMENTS

| | | | |
|---|---|---|---|
| 2,263,414 | 11/1941 | Beneshek et al. | 123/196 |
| 2,333,524 | 11/1943 | Conover et al. | 123/196 |
| 2,983,334 | 5/1961 | Dairymple | 184/6 |
| 3,144,095 | 8/1964 | Trapp et al. | 184/6 |
| 3,859,967 | 1/1975 | Turner et al. | 123/73 |
| 3,929,111 | 12/1975 | Turner et al. | 123/73 |
| 3,949,725 | 4/1976 | Jaulmes | 123/196 |
| 3,961,614 | 6/1976 | Rameau | 123/195 |
| 3,967,612 | 7/1976 | Yamada | 123/196 |
| 4,121,551 | 10/1978 | Turner | 123/196 |
| 4,121,559 | 10/1978 | Yamada | 123/196 |
| 4,777,913 | 10/1988 | Staerzl et al. | 123/73 |
| 4,903,654 | 2/1990 | Sato et al. | 123/196 |
| 4,947,807 | 8/1990 | Flaig et al. | 123/52 |
| 4,970,996 | 11/1990 | Matsuo et al. | 123/73 |
| 5,193,500 | 3/1993 | Haft | 123/196 |

*Primary Examiner*—Erick R. Solis
*Attorney, Agent, or Firm*—Michael, Best & Friedrich

[57] ABSTRACT

Disclosed herein is an internal combustion engine including first and second adjacent oppositely acting crankcases defined, in part, by a wall intermediate the first and second crankcases, a passageway through the wall and including a central portion and end portions which extends in opposite directions from the central portion, which are outwardly divergent, and which communicate with the first and second crankcases, whereby the central portion acts as a venturi consequent to air passage through the passageway between the crankcases incident to the pressure differential between the crankcases, and a conduit communicating with the central portion of the passageway for alternately supplying lubricating oil to the crankcases.

11 Claims, 5 Drawing Sheets

Fig. 7
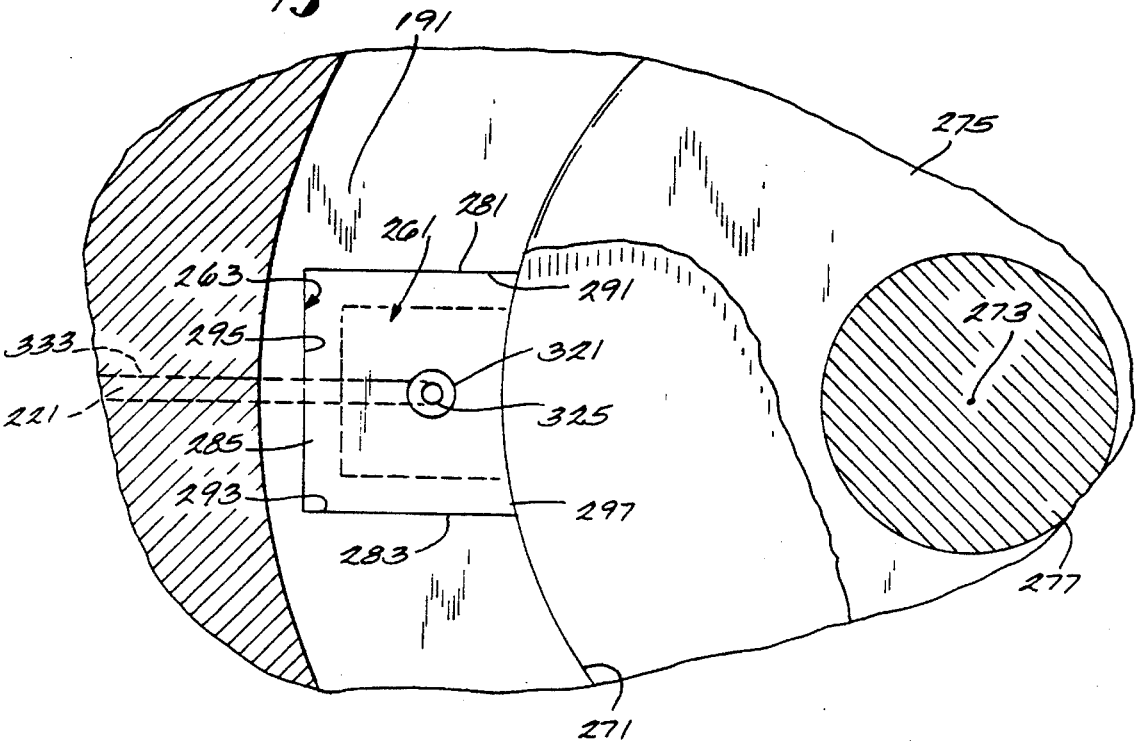
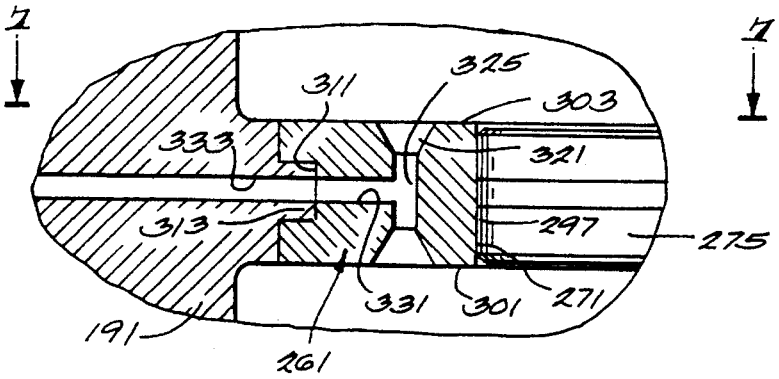
Fig. 6

INTERNAL COMBUSTION ENGINE WITH LUBRICATING OIL SUPPLY SYSTEM

This is a divisional of application Ser. No. 08/098,418, filed Jul. 27, 1993, entitled "Internal Combustion Engine with Lubricating Oil Supply System", now U.S. Pat. No. 5,471,958.

BACKGROUND OF THE INVENTION

The invention relates generally to two stroke, internal combustion engines, and, more particularly, to arrangements for supplying lubricating oil to such engines for the purpose of engine lubrication.

In the past, it has been common to mix oil with the fuel which are supplied to the engine in an air-fuel mixture which is supplied to the engine through a carburetor. However, in fuel injected engines, the fuel is supplied to the engine unmixed with oil and other arrangements must be employed to supply air and to lubricate the engine.

Attention is directed to U.S. application Ser. No. 654,088 filed Feb. 11, 1991 and to U.S. Pat. No. 3,144,095.

Attention is also directed to the following United States patents:

| U.S. Pat. No. | Inventor |
|---|---|
| 2,263,414 | Beneshek et al. |
| 2,333,524 | Conover et al. |
| 2,983,334 | Dalrymple |
| 3,144,095 | Trapp et al. |
| 3,859,967 | Turner |
| 3,929,111 | Turner |
| 3,949,725 | Jaulmes |
| 3,961,614 | Rameau |
| 3,967,612 | Yamada |
| 4,121,551 | Turner |
| 4,121,559 | Yamada |
| 4,777,913 | Staerzl et al. |
| 4,903,654 | Sato et al. |
| 4,947,807 | Flag et al. |
| 4,970,996 | Matsuo |
| 5,193,500 | Haft |

SUMMARY OF THE INVENTION

The invention provides an internal combustion engine including first and second adjacent oppositely acting crankcases defined, in part, by a wall intermediate the first and second crankcases, a passageway through the wall and including a central portion and end portions which extends in opposite directions from the central portion, which are outwardly divergent, and which communicate with the first and second crankcases, whereby the central portion acts as a venturi consequent to air passage through the passageway between the crankcases incident to the pressure differential between the crankcases, and a conduit communicating with the central portion of the passageway for supplying fluid to the crankcases.

The invention also provides a two stroke internal combustion engine comprising first and second cylinders which are alternately fired at 180° intervals, first and second crankcases which respectively extend from the first and second cylinders and which respectively include first and second sumps, a wall extending between the first and second crankcases and having therein a passageway communicating between the first and second crankcases, a first drain recirculation line extending between the first crankcase sump and the passageway and a second drain recirculation line extending between the second crankcase sump and the passageway.

The invention also provides a two stroke internal combustion engine comprising first, second, third, and fourth cylinders which are fired at even 90° intervals in the order just recited; first, second, third, and fourth crankcases which respectively extend from the first, second, third, and fourth cylinders, which respectively extend in successively adjacent relation to each other and which respectively include first, second, third, and fourth sumps; a first wall extending between the first and second crankcases and having therein a first passageway communicating between the first and second crankcases; a second wall extending between the third and fourth crankcases and communicating between the third and fourth crankcases; a first drain recirculation line extending between the first crankcase sump and the second passageway; a second drain recirculation line extending between the second crankcase sump and the second passageway; a third drain recirculation line extending between the third crankcase sump and the first passageway; and a fourth drain recirculation line extending between the fourth crankcase sump and the first passageway.

The invention also provides a two stroke internal combustion engine comprising first, second, third, fourth, fifth, and sixth cylinders which are fired at even 60° intervals in the order just recited; first, second, third, fourth, fifth, and sixth crankcases which respectively extend from the first, second, third, fourth, fifth, and sixth cylinders, which are arranged so as to be successively out of phase by 60° and which respectively include first, second, third, fourth, fifth, and sixth sumps; a first wall extending between the first and second crankcases and having therein a first passageway communicating between the first and second crankcases; a second wall extending between the third and fourth crankcases and communicating between the that and fourth crankcases; a third wall extending between the fifth and sixth crankcases and having therein a third passageway communicating between the fifth and sixth crankcases; a first drain recirculation line extending between the fourth crankcase sump and the first passageway; a second drain recirculation line extending between the fifth crankcase sump and the first passageway; a third drain recirculation line extending between the sixth crankcase sump and the second passageway; a fourth drain recirculation line extending between the first crankcase sump and the second passageway; a fifth drain recirculation line extending between the second crankcase sump and the third passageway; and a sixth drain recirculation line extending between the third crankcase sump and the third passageway.

The invention also provides an engine comprising a wall partially defining separate first and second crankcases and having an arcuate surface extending at a uniform radius from the axis of crankshaft rotation, and a slot extending from the arcuate surface in a radial direction from the crankshaft axis and including a base, and a conduit section extending from the base, and an insert located in the slot and having an arcuate edge merging smoothly with the arcuate surface of the wall, a pair of spaced side faces which partially define the first and second crankcases, a passageway extending between the side faces, and a conduit section extending from the passageway to the base edge and communicating with the conduit section in the wall.

Other features of and advantages of the invention will become apparent to those skilled in the art upon review of the following detailed description, claims, and drawings.

IN THE DRAWINGS

FIG. 6 is an enlarged, fragmentary view, partially in section, of an insert and slot arrangement adapted for use in the combined system shown in FIG. 4.

FIG. 7 is a view taken along line 7—7 of FIG. 5.

Figure 1:
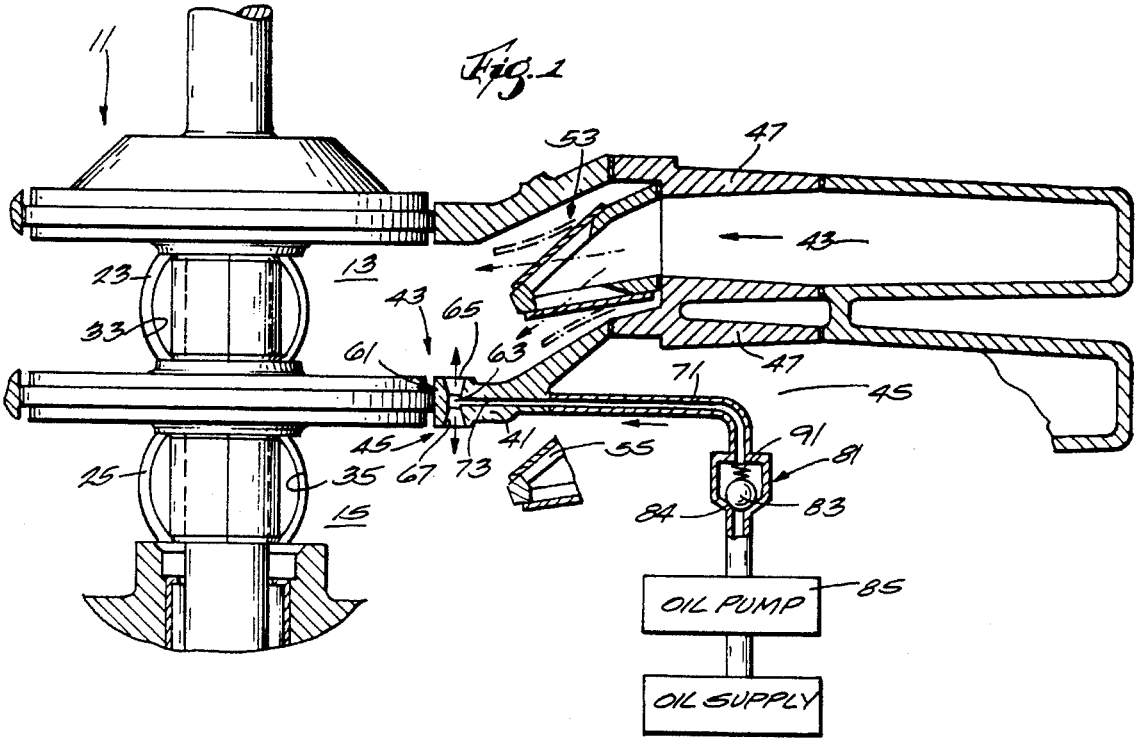
FIG. 1 is a fragmentary view, partially in section, of an internal combustion engine including a lubricating oil supply system in accordance with one embodiment of the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Shown fragmentarily in the drawings is a two-cycle, two-stroke, internal combustion engine 11 which can have two cylinders, four cylinders, or any multiple of two cylinders, and which, in the disclosed construction includes first and second crankcases 13 and 15, respectively, and which are operably respectively connected with oppositely acting first and second pistons 23 and 25 respectively reciprocable in first and second cylinders 33 and 35. As a consequence, the pressure variation in the first crankcase 13 is opposite from the pressure variation in the second crankcase 15, i.e. when the variable pressure in one of the crankcases 13 and 15 is relatively positive, the variable pressure in the other of the crankcases 13 and 15 is relatively negative.

The first and second crankcases 13 and 15 are formed, in part, by a wall 41 intervening therebetween and communicating respectively with first and second fuel-air mixture or air supply passages 43 and 45 which are provided in a unified or in separate intake manifold(s) 47 and which extend from suitable charge forming means, such as respective carburetors (not shown). In fuel injected engines, the air supply passage 43 and 45 supplies air only to the crankcases 13 and 15. Located between the intake manifold(s) 47 and the crankcases 13 and 15 are respective first and second reed valves 53 and 55 which permit inflow of air when the pressure in the associated one of the crankcases 13 and 15 is negative and which prevent outflow of air from the associated one of the crankcases 13 and 15 when the associated crankcase pressure is positive.

As thus far described, the construction is conventional.

The engine 11 also includes a lubricating oil supply system which, in the disclosed construction, includes a passageway 61 which extends between the first and second crankcases 13 and 15, which is preferably located closely adjacent to the reed valves 53 and 55, and which includes a central or restricted portion or venturi 63 and a pair of divergent portions 65 and 67 which respectively extend from the opposite ends of the central portion 63 and which respectively communicate with the first and second crankcases 13 and 15. This construction provides relatively low pressure in the central portion or venturi 63 consequent to the air flow through the passageway 61 in response to the pressure differential momentarily existing between the crankcases 13 and 15. The flow from the venturi 63 can be directed as deemed most effective, i.e., either across the associated crankcase, or toward the incoming air flows, or directly on a bearing to be oiled.

The engine 11 also includes means for supplying lubricating oil to the passageway 61 for distribution to both of the crankcases 13 and 15 consequent to crankcase pressure alternation. While other constructions can be employed, in the disclosed construction, such means comprises a conduit 71 which includes an outlet 73 communicating with the central portion 63 of the passageway 61 and which also communicates with a valve 81 controlling flow relative to the conduit 71. While any suitable construction can be employed in the disclosed construction, the valve 81 is provided by a ball member 83 engageable with a seat 84 to prevent flow relative to the conduit 71. Preferably, the conduit 71 includes an orifice 72 located adjacent the outlet 73. The size of the orifice 72 and the size of the venturi 63 interact to determine the rate of flow into the venturi 63 when the oil pump 85 is not operating. Perferably, in this regard, the oil flow rate is minimized so that oil is supplied to the venturi 63 during each engine cycle. In one embodiment, an orifice 72 with a 0.30" opening was employed with a venturi 63 having a diameter of 0.100".

The lubricating oil supply means also includes an oil pump 85 which can be of any conventional construction and which communicates with the valve 81 to supply lubricating oil through the valve 81 to the conduit 71 and hence to the passageway 61 and the crankcases 13 and 15.

The lubricating oil supply means also includes means biasing the valve 81 to a normally closed condition in the absence of oil pumping operation of the oil pump 85. While other constructions can be employed, in the disclosed construction, such biasing means comprises a spring 91 which bears against the ball member 83 and normally seats the ball member 83 against the seat 84 ball to prevent flow relative to the conduit 71 when the oil pump 85 is not operating, and to permit flow from the oil pump 85 to the conduit 71 in response to the oil pressure created incident to operation of the oil pump 85, which oil pressure creates a force greater than the force of the spring 91.

The variable pressure conditions existing in the central portion 63 of the passageway 61 consequent to the restriction provided by the central portion 63 serve to increase the speed or velocity of the air flow through the central portion 63, to thereby create a relatively negative pressure condition at the outlet 73 of the conduit 71, and to cause incoming lubricating oil to be more effectively atomized into a mist prior to discharge into the crankcases 13 and 15, i.e., to cause a finer atomization of the oil.

The negative pressure or suction created by the venturi 63 can, alternatively and, in some cases, be employed to pump oil from a suitably located oil source or tank, so long as the pressure in the oil in the outlet 73 is higher than the pressure in the venturi 63, and particularly if the oil source is elevated above the venturi 63, in which case the oil pump 85 can be omitted.

Figure 2:
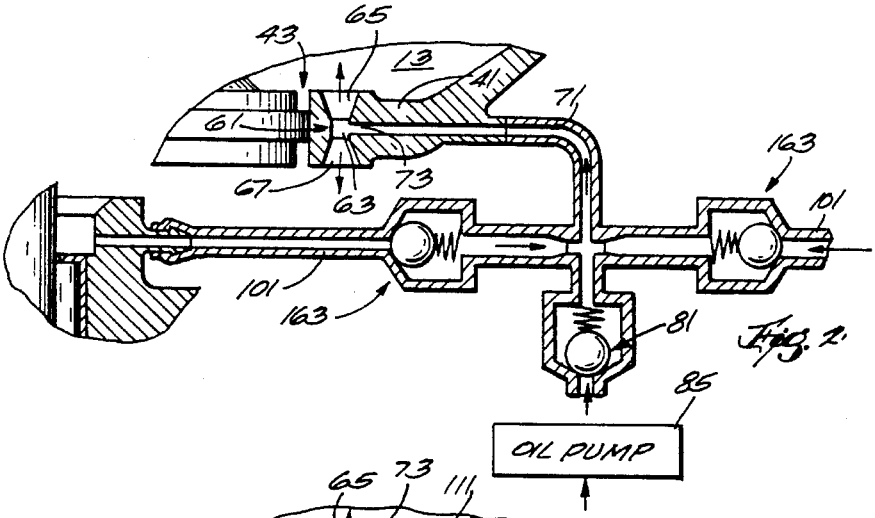
FIG. 2 is a fragmentary view, partially in section, of an internal combustion engine including a lubricating oil supply system in accordance with a second embodiment of the invention.

The venturi action of the central portion 63 of the passageway 61 can also be employed to assist in pumping "drains" from crankcases 13 and 15 and/or from other crankcases (not shown) and to assist in breaking up the lubricating oil in the drains into a mist. Pumping of oil drains in response to crankcase pressure variation is known in the art, as shown in the Turner U.S. Pat. Nos. 4,121,551; 3,859,967; and 3,929,111 (which are incorporated herein by reference). In the disclosed construction, however, the delivery of such oil drains through a venturi to an engine crankcase serves to assist in breaking up the drains into a mist. Accordingly, in the disclosed construction, as shown in FIG. 2, one or more conventional oil drain line(s) 101 communicate with the conduit 71 in the area between the outlet 73 and the valve 81. As in conventional constructions, the oil drain line(s) 101 each includes a check valve 163 which is suitably biased to prevent flow from the crankcases 13 and 15 and to permit flow to the crankcases 13 and 15 in response to variation in crankcase pressures. Thus, the pressures in the crankcases 13 and 15 act directly on the oil drain line(s) 101 and serve to assist in the pumping of oil drains from the oil drain line(s) 101 and into the crankcases 13 and 15. As already pointed out, such passage of the oil drains (air and oil) through the venturi defined by the central conduit portion 73, also assists in breaking up the oil drains into a fine mist or atomization.

This air can come from the atmosphere or from another crankcase, phased so as to have positive pressure while the oil passage is negative. In conventional practice, phased positive pressure is employed to drain oil from low spots or sumps in one crankcase (along with some air or air-fuel mixture) and return the oil drains to another crankcase for distribution through the engine.

Figure 3:
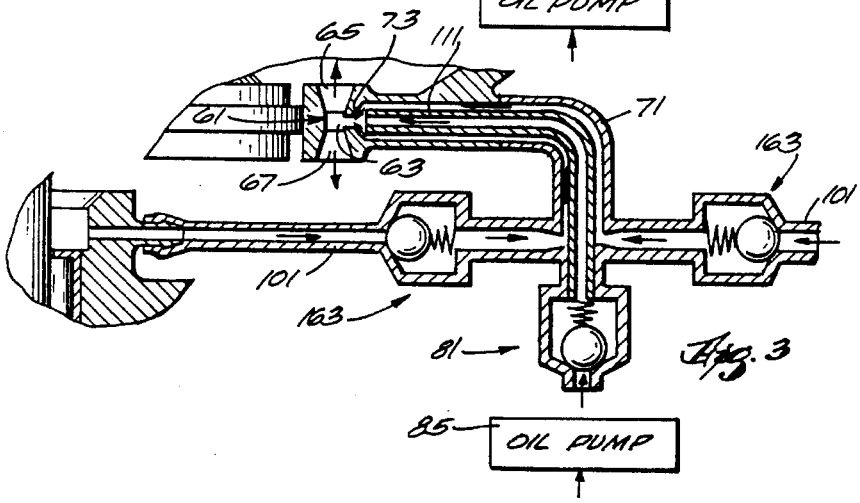
FIG. 3 is a fragmentary view, partially in section, of an internal combustion engine including a lubricating oil supply system in accordance with a third embodiment of the invention.

As shown in FIG. 3, still further increased mistification, i.e. breaking down of the lubricating oil into a mist, of the incoming oil from the pump 85 can be provided by introducing the oil drains into the conduit 71 in the area between the conduit outlet 73 and the communication of the oil drain line(s) 101 with the conduit 71, i.e., downstream of the introduction of oil drains or by introducing air (independently of oil drains) into the conduit 71 through one or more additional lines such as the line 101. While other constructions can be employed, in the disclosed construction, such means comprises a tube 111 which, at least in part, extends within the conduit and along the axis thereof and communicates, at one end thereof, with the conduit adjacent the outlet 73, which passes out of the conduit 71, and which, at the other end thereof, communicates with the valve 81. Within the conduit 71, the tube 111 is centrally located so that the flow from the incoming oil drain line(s) 101 encircles the tube 111 and the lubricating oil discharged from the tube 111. The incoming drains and/or air flowing from the line(s) 101 serve to further break up the incoming lubricating oil prior to arrival at the venturi provided by the central passageway portion 63 and to provide a still finer mist or atomization.

Figures 4, 5:
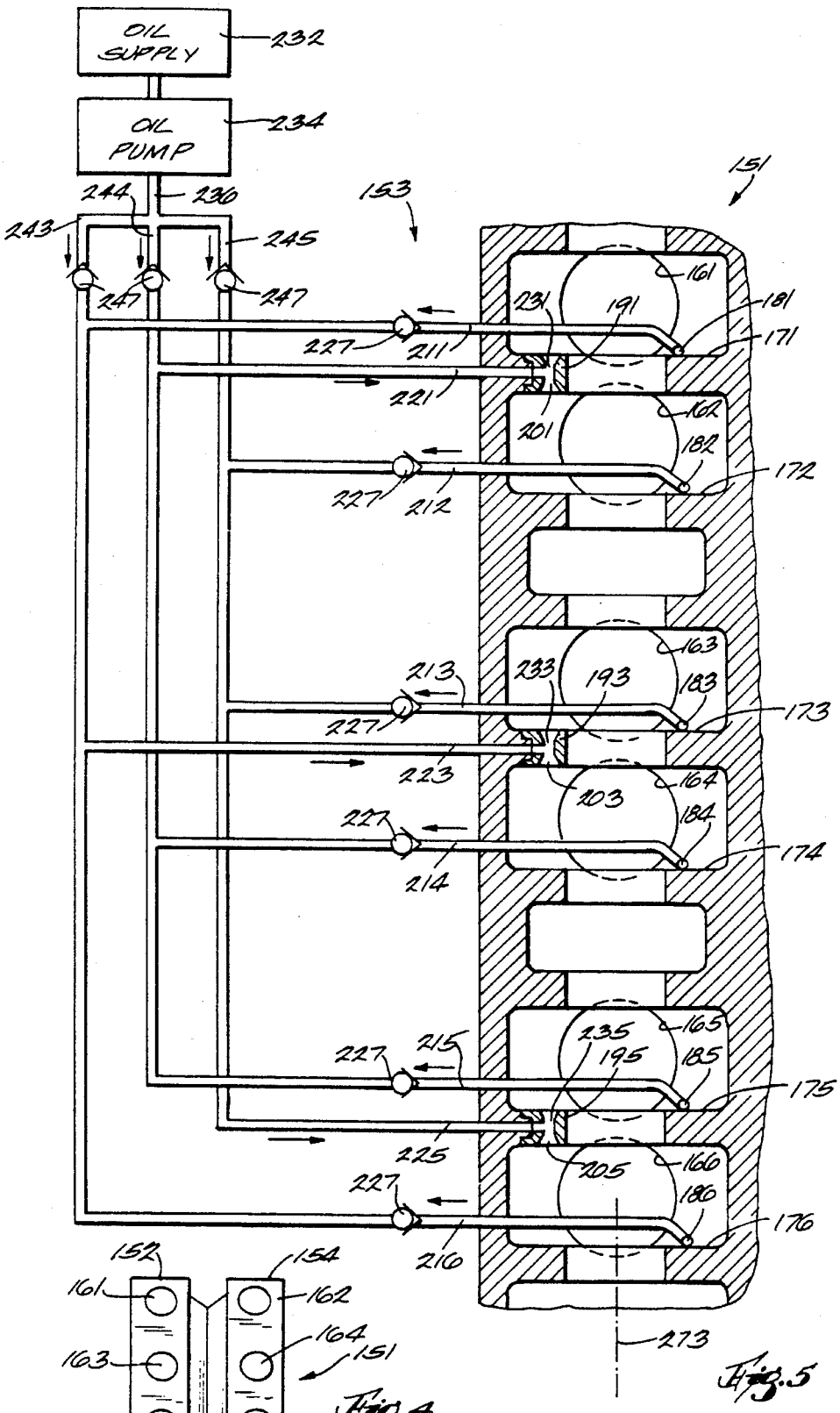
FIG. 4 is a schematic view of a six cylinder engine embodying various of the features of the invention.
FIG. 5 is a schematic view of a combined system for supplying lubricating oil and for recirculating oil drains in the engine shown in FIG. 4.

Shown fragmentarily and schematically in FIGS. 4 and 5 is a six-cylinder two-stroke engine 151 which includes a combined system 153 for supplying lubricating oil to the engine and for optimizing oil drains recirculation so as to remove oil drains from the engine crankcases and to return such oil drains to the engine crankcases in a lubricating mist adapted to be carried throughout the engine 151 for lubrication thereof.

The engine 151 illustrated sematically in FIGS. 4 and 5 includes a V-shaped block including two cylinder banks 152 and 154 which are arranged at an inclined angle to each other and which define six cylinders. More partially as shown in FIG. 4, the cylinder bank 152 include first, third and fifth cylinders 161, 163, and 165, and the other cylinder bank includes cylinders 162, 164, and 166. While the engine block is of V-configuration, the engine can also be of in-line configuration.

The first, second, third, fourth, fifth, and sixth cylinders 161, 162, 163, 164, 165, and 166 respectively extend from first, second, third, fourth, fifth, and sixth crankcases 171, 172, 173, 174, 175, and 176 respectively having low areas or sumps 181, 182, 183, 184, 185, and 186 wherein oil drains tend to accumulate or collect in liquid form. The cylinders 161, 162, 163, 164, 165, and 166 respectively include pistons (not shown) which are arranged relative to a crankshaft (not shown) so that the cylinders 161, 162, 163, 164, 165, and 166 are successively out of phase, and, in particular, out of phase by 60°.

The engine 151 also includes an ignition system (not shown) which functions to fire the cylinders 161, 162, 163, 164, 165, and 166 in that order and at intervals of an even 60° of crankshaft rotation.

The first and second crankcase 171 and 172 are separated and defined, in part, by a first wall 191 having therein a first passageway 201 communicating between the first and second crankcases 171 and 172.

The third and fourth crankcases 173 and 174 are separated and defined, in part, by a second wall 193 having therein a second passageway 203 communicating between the third and fourth crankcases 173 and 174.

The fifth and sixth crankcases 175 and 176 are separated and defined, in part, by a third wall 195 having therein a third passageway 205 communicating between the fifth and sixth crankcases 175 and 176.

The combined system 153 also includes means whereby oil drains accumulating in the crankcases 171, 172, 173, 174, 175, and 176 are reintroduced into the crankcases 171, 172, 173, 174, 175, and 176 as a lubricating mist in an optimized oil drains recirculation arrangement. While other constructions can be employed, in the disclosed construction, such means comprises respective communication of the fourth and fifth crankcase sumps 184 and 185 with drain recirculation lines 214 and 215 which, in turn, communicate with a conduit 221 communicating with the first passageway 201 in a manner as shown in either of FIGS. 2 and 3.

Such means also includes respective communication of the first and sixth crankcase sumps 181 and 186 with drain recirculation lines 211 and 216 which, in turn, communicate with a conduit 223 communicating with the second passageway 203 in a manner as shown in either of FIGS. 2 and 3.

Such means also includes respective communication of the second and third crankcase sumps 182 and 183 with drain recirculation lines 212 and 283 which, in turn, communicate with conduit 225 communicating with the third passageway 205 in a manner as shown in either of FIGS. 2 and 3.

The drain recirculation lines 211, 212, 213, 214, 215, and 216 respectively includes check valves 227 permitting flow of the liquid oil drains from the associated crankcases and preventing flow to the associated crankcases.

Preferably, the passageways 201, 203, and 205 respectively includes venturis 231, 233, and 235 as already described with respect to FIGS. 1, 2, and 3 and the drain recirculation lines 211, 212, 213, 214, 215, and 216 can be arranged with respect to the first, second, and third passageways 201, 203, and 205 as shown in either of FIGS. 2 and 3. Preferably however, the recirculating drain lines 211, 212, 213, 214, 215, and 216 are arranged with respect to the passageways 201, 203, and 205 as shown in FIG. 3.

In operation, when the piston associated with the cylinder 161 approaches top dead center (for firing), the piston associated with the cylinder 162 is about 60° before top dead center. As a consequence the pressure in the crankcase 172 is greater than the pressure in the crankcase 171, and gas flows through the passage 201 from the crankcase 172 to the crankcase 171. At the same time, the piston associated with the cylinder 163 is about 120° before top dead center, the piston associated with the cylinder 164 is about 180° before top dead center, the piston associated with the cylinder 165 is about 240° before top dead center, and the piston associated with the cylinder 166 is about 300° before top dead center, Because the pistons associated with the cylinders 164 and 165 are respectively 180° and 240° before top dead center, the pressures in the associated crankcases 174 and 175 are greater than the pressure in the crankcase 172, thereby causing pumping of the oil drains from the crankcases 174 and 175, through the drain recirculation lines 214 and 215, into the conduit 221, and into the passage 201. Such incoming oil drains are thereafter turned into a mist by the gas flowing through the passageway 201 and delivered to the crankcase 171.

The next piston to approach top dead center is associated with the cylinder 162, and the piston associated with the cylinder 161 is then about 60° after top dead center, with the result that the pressure in the crankcase 171 is greater than the pressure in the crankcase 172. Consequently, gas flows through the passage 201 from the crankcase 171 to the crankcase 172. At the same time, the pistons associated with the cylinders 164 and 165 are now respectively spaced from top dead center by about 120° and 180°, with the result that the pressures in the crankcases 173 and 174 are greater than in the crankcase 171. Consequently the oil drains in the crankcases 174 and 175 are pumped through the drain recirculation lines 214 and 215, into the conduit 221, and into the passage 201. Such incoming oil drains are thereafter turned into a mist by the gas flowing through the passageway 201 and are delivered to the crankcase 172.

The next piston to approach top dead center is associated with the cylinder 163, and the piston associated with the cylinder 164 is then about 60° before top dead center, with the result that the pressure in the crankcase 174 is greater than the pressure in the crankcase 173. Consequently, gas flows through the passage 203 from the crankcase 174 to the crankcase 173. At the same time, the pistons associated with the cylinders 161 and 166 are respectively spaced from top dead center by about 180° and 240°, with the result that the pressures in the crankcases 171 and 176 are greater than in the crankcase 174. Consequently the oil drains in the crankcases 171 and 176 are pumped through the drain recirculation lines 211 and 216, into the conduit 223, and into the passage 203. Such incoming oil drains are thereafter turned into a mist by the gas flowing through the passageway 203 and are delivered to the crankcase 173.

The next piston to approach top dead center is associated with the cylinder 164, and the piston associated with the cylinder 163 is then about 60° after top dead center, with the result that the pressure in the crankcase 173 is greater than the pressure in the crankcase 174. Consequently, gas flows through the passage 203 from the crankcase 173 to the crankcase 174. At the same time, the pistons associated with the cylinders 161 and 166 are respectively spaced from top dead center by about 120° and 180°, with the result that the pressures in the crankcases 171 and 176 are greater than in the crankcase 173. Consequently the oil drains in the crankcases 171 and 176 are pumped through the drain recirculation lines 211 and 216, into the drain conduit 223, and into the passage 203. Such incoming oil drains are thereafter turned into a mist by the gas flowing through the passageway 203 and are delivered to the crankcase 174.

The next piston to approach top dead center is associated with the cylinder 165, and the piston associated with the cylinder 166 is then about 60° before top dead center, with the result that the pressure in the crankcase 176 is greater than the pressure in the crankcase 175. Consequently, gas flows through the passage 205 from the crankcase 176 to the crankcase 175. At the same time, the pistons associated with the cylinders 162 and 163 are respectively spaced from top dead center by about 180° and 240°, with the result that the pressures in the crankcases 172 and 173 are greater than in the crankcase 176. Consequently the oil drains in the crankcases 172 and 173 are pumped through the drain recirculation lines 212 and 213, into the conduit 225, and into the passage 205. Such incoming oil drains are thereafter turned into a mist by the gas flowing through the passageway 205 and are delivered to the crankcase 175.

The next piston to approach top dead center is associated with the cylinder 166, and the piston associated with the cylinder 165 is then about 60° after top dead center, with the result that the pressure in the crankcase 175 is greater than the pressure in the crankcase 176. Consequently, gas flows through the passage 205 from the crankcase 175 to the crankcase 176. At the same time, the pistons associated with the cylinders 163 and 162 are respectively spaced from top dead center by about 120° and 180°, with the result that the pressures in the crankcases 172 and 173 are greater than in the crankcase 175. Consequently the oil drains in the crankcases 172 and 173 are pumped through the drain recirculation lines 212 and 213, into the conduit 225, and into the passage 205. Such incoming oil drains are thereafter turned into a mist by the gas flowing through the passageway 205 and are delivered to the crankcase 176.

The combined system 153 also includes an oil supply or reservoir 232 which communicates with an oil pump 234 which, in turn, discharges lubricating oil into a discharge line 236 including three branches 341, 343, and 345 which respectively communicate with the conduits 221, 223, and 225. The branches 341, 343, and 345 are respectively provided with check valves 347 which permit flow from the oil pump 234 and which prevent flow to the oil pump 234.

The passageways 201, 203, and 205 are preferably provided in respective inserts and which are preferably fabricated of plastic and which are respectively relatively tightly received in associated slots in the walls 191, 193, and 195 defining the adjacent crankcases and so as not to detract from the generally sealed condition of the adjacent crankcases and so as also to prevent leakage of the oil and oil drains flowing therein. More particularly, while other constructions can be employed, in the disclosed construction, the inserts are generally of identical construction, as are the associate slots, and accordingly, only the insert 261 and the slot 263 associated with the crankcase wall 191 will be described.

As shown in FIG. 6, the wall 191 terminates in an arcuate surface 271 which extends at a uniform radius from the crankshaft axis 273 and which mates with an associated crankdisk 275 on a crankshaft 277. The slot 263 extends, with respect to the crankshaft axis 273, radially inwardly from the arcuate surface 271 and is generally of U-shape including two spaced generally parallel sides 281 and 283 and a connecting bottom 285. Of course, other shapes could be employed.

The insert 261 has a shape corresponding to the shape of the slot 263. In this regard, the insert 261 includes spaced side edges 291 and 293 and a bottom edge 295 corresponding to the sides 281 and 283 and the bottom 285 of the slot 263, and an arcuate edge 297 which merges smoothly with the arcuate surface 271 of the wall 191 and extends, with the arcuate surface 271, at a common radius from the crankcase axis 273. In addition, the insert 261 has a thickness which is generally identical to the thickness of the wall 191 and has two generally parallel side faces 301 and 303 faces which are generally co-planar with the adjacent side faces of the wall.

The insert 261 and the slot 263 include means for pre-mitting insertion of the insert 261 into the slot 263 (in a direction extending radially from the crankshaft axis 273) and for preventing relative movement between the insert 261 and the slot 263 in the direction of the crankshaft axis 273.

While other arrangements can be employed, in the disclosed construction, and as best shown in FIG. 7, the insert 261 includes a peripheral groove 311 extending along the side edges 291 and 293 and bottom edge 295 and the slot 263 includes a mating rib 313 extending along the sides 281 and 283 and the bottom 285 thereof. Thus the insert 261 can be radially inserted into the slot 263 and retained in position by reason of the relatively close or tight fit between the insert 261 and the slot 263 and because of the abutting relationship of the arcuate edge 297 of the insert 261 and the circular periphery of the associated crankdisk 275.

The insert 261 is provided with a transverse passageway 321 which extends between the side faces 301 and 303 and which provides the before disclosed passageway 201, and which, as already indicated, preferably includes a central venturi 325.

Communicating between the venturi 325 and the bottom edge 295 of the insert 261 is a conduit section 331 which forms part of the associated drain conduit 221 and which, in turn, when the insert 261 is position in the slot 263, communicates with a conduit section 333 which is formed in the crankcase wall 191, which forms part of the associated drain conduit 221, which extends to the exterior of the crankcase structure, and which is provided with a suitable fitting (not shown) facilitating connection to an exterior conduit forming a part of the associated drain conduit 221. Accordingly, with the slot and insert arrangement just described, the crankcase wall 191 can be readily provided with the desired passageway 201 by inexpensive molding of the insert 261 and by radial insertion of the insert 261 into the slot 263.

Figure 9:
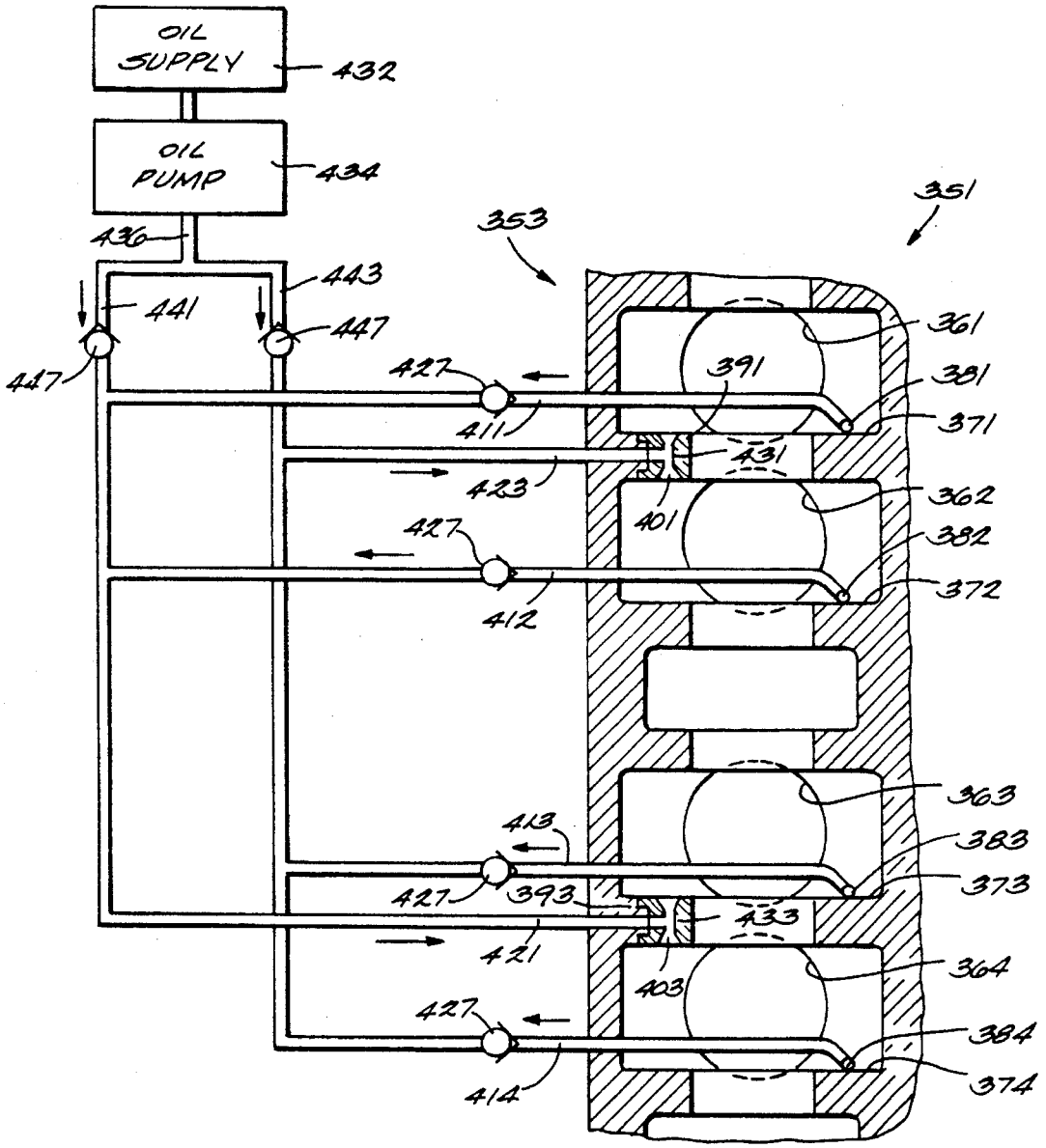
FIG. 9 is a schematic view of a combined system for supplying lubricating oil and for recirculating oil drains in the engine shown in FIG. 8.
Figure 8:
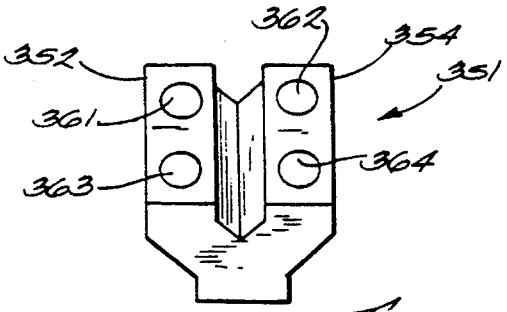
FIG. 8 is a schematic view of a four cylinder engine embodying various of the features of the invention.

Shown fragmentarily and schematically in FIGS. 8 and 9 is a four-cylinder two-stroke engine 351 which includes a combined system 353 for supplying lubricating oil to the engine and for optimizing oil drains recirculation so as to remove oil drains from the engine crankcases and to return such oil drains to the engine crankcases in a lubricating mist adapted to be carried throughout the engine 351 for lubrication thereof. The engine 351 illustrated sematically in FIGS. 8 and 9 includes a V-shaped block including two cylinder banks 352 and 354 which are arranged at an inclined angle to each other and which define four cylinders 361, 362, 363, and 364. More partially as shown in FIG. 6, the cylinder bank 352 include the first, and third cylinders 361 and 363, and the other cylinder bank 354 includes the cylinders 362 and 364. While the engine block is of V-configuration, the engine can also be of in-line configuration.

The first, second, third, and fourth cylinders 361, 362, 363, and 364 respectively extend from first, second, third, and fourth crankcases 371, 372, 373, and 374 respectively including low areas or sumps 381, 382, 383, and 384 wherein oil drains tend to accumulate or collect in liquid form. The cylinders 161, 162, 163, and 164 respectively include pistons (not shown) which are arranged relative to a crankshaft (not shown) so that the cylinders 361, 362, 363, and 364 are successively out of phase and, in particular, out of phase by 90°.

The engine 351 also includes an ignition system (not shown) which functions to fire the cylinders 361, 362, 363, and 364 in that order and at intervals of an even 90° of crankshaft rotation.

The first and second crankcase 371 and 372 are separated and defined, in part, by a first wall 391 having therein a first passageway 401 communicating between the first and second crankcases 371 and 372.

The third and fourth crankcases 373 and 374 are separated and defined, in part, by a second wall 393 having therein a second passageway 403 communicating between the third and fourth crankcases 373 and 374.

The combined system 353 also includes means whereby oil drains accumulating in the crankcases 371, 372, 373, and 374 are reintroduced into the crankcases 371, 372, 373, and 374 as a lubricating mist in an optimized oil drains recirculation arrangement. While other constructions can be employed, in the disclosed construction, such means comprises respective communication of the first and second crankcase sumps 381 and 382 with drain recirculation lines 411 and 412 which, in turn, communicate with a conduit 421 communicating with the second passageway 403 in a manner as shown in either of FIGS. 2 and 3.

Such means also includes respective communication of the third and fourth crankcase sumps 383 and 384 with drain recirculation lines 413 and 414 which, in turn, communicate with a conduit 423 communicating with the first passageway 403 in a manner as shown in either of FIGS. 2 and 3.

The drain recirculation lines 411, 412, 413, and 414 respectively includes check valves 427 permitting flow of the liquid oil drains from the associated crankcases and preventing flow to the associated crankcases.

Preferably, the passageways 401 and 403 respectively includes venturis 431 and 433 as already described with respect to FIGS. 1, 2, and 3 and the drain recirculation lines 411, 412, 413, and 414 can be arranged with respect to the first and second passageways 401 and 403 as shown in either of FIGS. 2 and 3. Preferably however, the recirculating drain lines 411, 412, 413, and 214 are arranged with respect to the passageways 401 and 403 as shown in FIG. 3.

In operation, when the piston associated with the first cylinder 361 approaches top dead center (for firing), the piston associated with the cylinder 362 is about 90° before top dead center. As a consequence the pressure in the crankcase 372 is greater than the pressure in the crankcase 371, and gas flows through the passage 401 from the crankcase 372 to the crankcase 371. At the same time, the piston associated with the cylinder 363 is about 180° before top dead center, and the piston associated with the cylinder 364 is about 270° before top dead center. Because the piston associated with the cylinders 363 is 180° before top dead center, the pressures in the associated crankcase 373 is greater than the pressure in the crankcase 372, thereby causing pumping of the oil drains from the crankcases 373, through the drain recirculation lines 413, into the conduit 421, and into the passage 401. Such incoming oil drains are thereafter turned into a mist by the gas flowing through the passageway 401 and delivered to the crankcase 371.

The next piston to approach top dead center is associated with the cylinder 362, and the piston associated with the cylinder 361 is then about 90° after top dead center, with the result that the pressure in the crankcase 371 is greater than the pressure in the crankcase 372. Consequently, gas flows through the passage 401 from the crankcase 371 to the crankcase 372. At the same time, the pistons associated with the cylinders 363 and 364 are now respectively spaced after top dead center by about 270° and 180°, with the result that the pressures in the crankcase 374 is greater than in the crankcase 371. Consequently the oil drains in the crankcase 374 are pumped through the drain recirculation line 414, into the conduit 421, and into the passage 401. Such incoming oil drains are thereafter turned into a mist by the gas flowing through the passageway 401 and are delivered to the crankcase 372.

The next piston to approach top dead center is associated with the cylinder 363, and the piston associated with the cylinder 364 is then about 90° before top dead center, with the result that the pressure in the crankcase 374 is greater than the pressure in the crankcase 373. Consequently, gas flows through the passage 403 from the crankcase 374 to the crankcase 373. At the same time, the pistons associated with the cylinders 361 and 363 are respectively spaced before top dead center by about 180° and 270°, with the result that the pressures in the crankcase 371 is greater than in the crankcase 374. Consequently the oil drains in the crankcase 371 are pumped through the drain recirculation line 411, into the conduit 423, and into the passage 403. Such incoming oil drains are thereafter turned into a mist by the gas flowing through the passageway 403 and are delivered to the crankcase 373.

The next piston to approach top dead center is associated with the cylinder 364, and the piston associated with the cylinder 363 is then about 90° after top dead center, with the result that the pressure in the crankcase 373 is greater than the pressure in the crankcase 374. Consequently, gas flows through the passage 403 from the crankcase 373 to the crankcase 374. At the same time, the pistons associated with the cylinders 361 and 362 are respectively spaced after top dead center by about 270° and 180° with the result that the pressure in the crankcase 372 is greater than in the crankcase 373. Consequently the oil drains in the crankcase 372 are pumped through the drain recirculation line 412, into the conduit 423, and into the passage 403. Such incoming oil drains are thereafter turned into a mist by the gas flowing through the passageway 403 and are delivered to the crankcase 374.

The combined system 353 also includes, as in connection with the engine 251, an oil supply or reservoir 432 which communicates with an oil pump 434 which, in turn, discharges lubricating oil into a discharge line 436 including two branches 441 and 443 which respectively communicate with the drain conduits 421 and 423. The branches 441 and 443 are respectively provided with check valves 447 which permit flow from the oil pump 434 and which prevent flow to the oil pump 434.

The passageways 401 and 403 are preferably provided in respective inserts, such as the insert 261.

Figure 10:
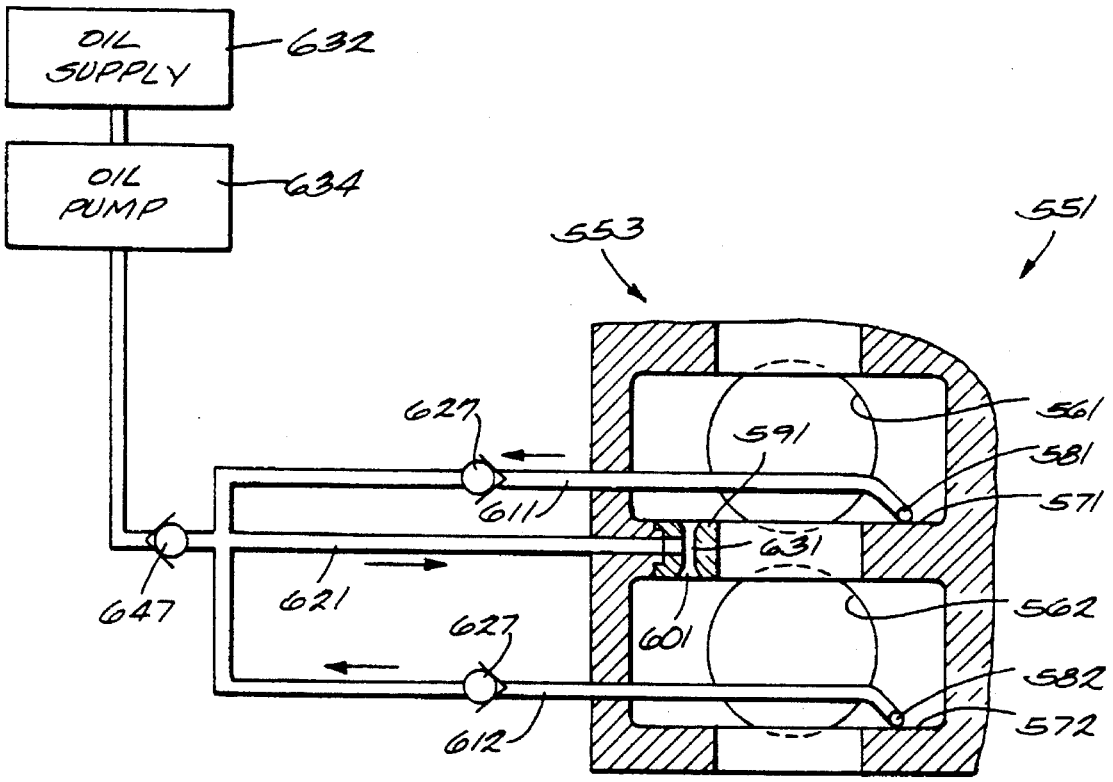
FIG. 10 is a schematic view of a combined system for supplying lubricating oil and for recirculating oil drains in a two cylinder two stroke engine.

Shown fragmentarily and schematically in FIG. 10 is a two-cylinder two-stroke engine 551 which includes two alternately operating cylinders 561 and 562 and a combined system 553 for supplying lubricating oil to the engine and for optimizing oil drains recirculation so as to remove oil drains from the engine crankcases and to return such oil drains to the engine crankcases in a lubricating mist adapted to be carried throughout the engine 551 for lubrication thereof. The engine 551 illustrated schematically in FIG. 10 also includes first and second crankcases 571 and 572 respectively extending from the first and second cylinders 561 and 562 and including low areas or sumps 581 and 582 wherein oil drains tend to accumulate or collect in liquid form. The cylinders 561 and 562 respectively include pistons (not shown) which are arranged relative to a crankshaft (not shown) so that the cylinders 561 and 562 are out of phase, i.e., adjacent crankcases have positive and negative pressures at different times. In the engine 551, the out of phase angle is 180°.

The engine 551 also includes an ignition system (not shown) which functions to fire the cylinders 561 and 562 at intervals of 180° of crankshaft rotation.

The first and second crankcases 571 and 572 are separated and defined, in part, by a wall 591 having therein a passageway 601 communicating between the first and second crankcases 571 and 572 and preferably including a venturi 631 as already described. In addition, the passageway 601 is preferably provided in an insert, such as the insert 261.

The combined system 353 also includes means whereby oil drains accumulating in the crankcases 571 and 572 are reintroduced into the crankcases 571 and 572 as a lubricating mist in an optimized oil drains recirculation arrangement. While other constructions can be employed, in the disclosed construction, such means comprises respective communication of the first and second crankcase sumps 581 and 582 with drain recirculation lines 611 and 612 which, in turn, communicate with a conduit 621 communicating with the passageway 601.

The drain recirculation lines 411 and 412 respectively includes check valves 627 permitting flow of the liquid oil drains from the associated crankcases and preventing flow to the associated crankcases.

In operation, when the piston associated with the first cylinder 561 approaches top dead center (for firing), the piston associated with the cylinder 562 is about 180° before top dead center. As a consequence, the pressure in the crankcase 572 is greater than the pressure in the crankcase 571, and gas flows through the passage 601 from the crankcase 572 to the crankcase 571. At the same time, because the pressure in the crankcase 573 is greater than the pressure in the crankcase 372, the resulting pressure differential causes flow of oil drains from the crankcase sump 581, through the drain recirculation line 611, the through conduit 621, and into the passage 601. Such incoming oil drains are thereafter turned into a mist by the gas flowing through the passageway 401 and delivered to the crankcase 371.

When the other piston approaches top dead center, there is flow through the passageway 601 in the opposite direction and flow of oil drains from the sump 582 to the passageway 601

The combined system 553 also includes, as in connection with the engine 151 and 351, an oil supply or reservoir 632 which communicates with an oil pump 634 which, in turn, discharges lubricating oil into a discharge line 636 communicating with the drain recirculation lines 611 and 612 and with the conduit 621. The discharge line 636 is provided with a check valve 647 which permits flow from the oil pump 634 and which prevents flow to the oil pump 634.

While the engines 151, 351, and 551 are operating at high speeds, for instance between 5000 and 6000 RPM, the oil pump 234, 434, and 634 functions only during a percentage of the operational time to deliver to the engine through the venturi or venturis a desired amount of lubrication. Thus, the remaining operational time is available for pumping oil drains from the sumps. In order to facilitate such operation, the check valves 247, 447, and 647 in the oil pump discharge line 636 or in the branches 243, 244, 245, 441, and 443 can be set at a relatively high pressure as for instance 80 psi whereas the check valves 227, 427, and 627 in the drain recirculation lines 211, 212, 213, 214, 215, 216, 411, 412, 413,414, 611, and 612 are set to open at a much lower pressure than the pressure which is operative to open the check valves 247, 447, and 647. Thus, when the oil pump is not operating, i.e., not delivering oil under pressure, the suction created by the venturi(s) 231, 333, and 235, 431 and 433, and 631 consequent to flow between adjacent crankcase, combined with whatever positive pressure is available in an out-of-phase crankcase, will be effective to unseat the check valves 227, 427, and 627 in the drain recirculation lines, thereby affording drains recirculation during the period of pump non-operation. In this last regard, the opening of the check valves 227, 427, and 627 will also serve to cause flow of whatever recently supplied lubricating oil is in the conduit(s) 221, 223, 225, 421, 423, and 621 downstream from the communication with the drains recirculation lines prior to causing discharge of oil drains into the venturi(s).

While two, four, and six cylinder engines have been described herein, the features of the invention are also applicable to eight cylinder engines.

Various of the features of the invention are set forth in the following claims.

We claim:

1. An internal combustion engine including first and second adjacent oppositely acting crankcases defined, in part, by a wall intermediate said first and second crankcases, a passageway through said wall and including a central portion and end portions which extends in opposite directions from said central portion, which are outwardly divergent, and which communicate with said first and second crankcases, whereby said central portion acts as a venturi consequent to air passage through said passageway between said crankcases incident to the pressure differential between said crankcases, and a conduit communicating with said central portion of said passageway for supplying fluid to said crankcases.

2. An internal combustion engine in accordance with claim 1 wherein said fluid supplied to said passageway is oil and further including a source of oil communicating with said conduit, and a check valve located in said conduit and operable to permit oil flow from said oil source to said passageway and to prevent oil flow from said passageway to said oil source.

3. An internal combustion engine in accordance with claim 2 wherein said oil source includes an oil pump communicating with said conduit.

4. An internal combustion engine in accordance with claim 2 and further including a drains return line communicating with said conduit at a location between said valve and said passageway.

5. An internal combustion engine in accordance with claim 2 and further including an oil tube having a first end communicating with said conduit between said passageway and said location of the communication between said conduit and said drains return line and having a second end communicating with said normally closed valve.

6. An internal combustion engine in accordance with claim 5 wherein said tube extends, at least in part, within said conduit for a portion of the length of said conduit.

7. An engine comprising a wall partially defining separate first and second crankcases and having an arcuate surface extending at a uniform radius from the axis of crankshaft rotation, and a slot extending from said arcuate surface in a radial direction from said crankshaft axis and including a base, and a conduit section extending from said base, and an insert located in said slot and having an arcuate edge merging smoothly with said arcuate surface of said wall, a pair of spaced side faces which partially define said first and second crankcases, a passageway extending between said side faces, and a conduit section extending from said passageway to said base edge and communicating with said conduit section in said wall.

8. An engine in accordance with claim 7 where said passageway includes centrally thereof a venturi, and wherein said conduit passage in said insert communicate with said venturi in said passageway.

9. An engine in accordance with claim 7 wherein said slot and said insert include means preventing relative movement therebetween in the direction of the crankshaft axis.

10. An engine in accordance with claim 9 wherein said means for preventing relative movement between said slot and said insert includes a peripheral rib on one of said slot and said insert and a groove in the other of said slot and said insert and receiving said rib.

11. An engine in accordance with claim 10 wherein said rib is provided on said slot.

* * * * *